US009783763B2

(12) United States Patent
Guay et al.

(10) Patent No.: US 9,783,763 B2
(45) **Date of Patent: *Oct. 10, 2017**

(54) METHOD OF REMOVING A CONTAMINANT FROM A CONTAMINANT-CONTAINING BIOLOGICAL COMPOSITION USEFUL AS A BIOFUEL FEEDSTOCK

(71) Applicant: REG SYNTHETIC FUELS, LLC, Ames, IA (US)

(72) Inventors: Peter Guay, Baton Rouge, LA (US); Dale Graham, Dakota Dunes, SD (US); Ramin Abhari, Bixby, OK (US); Peter Zdenek Havlik, Tulsa, OK (US); Edward Gary Roth, Bristow, OK (US); H. Lynn Tomlinson, Leonard, OK (US)

(73) Assignee: REG SYNTHETIC FUELS, LLC, Ames, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/225,548

(22) Filed: Aug. 1, 2016

(65) Prior Publication Data

US 2016/0340605 A1 Nov. 24, 2016

Related U.S. Application Data

(63) Continuation of application No. 14/775,095, filed as application No. PCT/US2014/020228 on Mar. 4, 2014, now Pat. No. 9,404,064.

(Continued)

(51) Int. Cl.

| | |
|---|---|
| ***C11B 3/00*** | (2006.01) |
| ***C11B 3/04*** | (2006.01) |
| ***C11B 3/16*** | (2006.01) |

(52) U.S. Cl.

CPC ..... *C11B 3/001* (2013.01); *C11B 3/006* (2013.01); *C11B 3/04* (2013.01); *C11B 3/16* (2013.01)

(58) Field of Classification Search

None

See application file for complete search history.

(56) References Cited

U.S. PATENT DOCUMENTS

| | | | |
|---|---|---|---|
| 3,634,475 | A | 1/1972 | Beal et al. |
| 6,426,423 | B1 | 7/2002 | Copeland et al. |

(Continued)

FOREIGN PATENT DOCUMENTS

| | | | |
|---|---|---|---|
| EP | 0 077 528 | A1 | 4/1983 |
| EP | 0 583 648 | A2 | 2/1994 |

(Continued)

OTHER PUBLICATIONS

"A Buyer's Guide to Rendered Fats," Render Magazine, Feb. 2009, pp. 14-19.

(Continued)

*Primary Examiner* — Yate K Cutliff

(74) *Attorney, Agent, or Firm* — Foley & Lardner LLP

(57) ABSTRACT

Biological compositions containing animal fats and plant oils desirably are free of contaminants prior to processing into a biofuel. Disclosed herein is a method of removing such contaminants from these compositions to make that processing more efficient. The method employs a unique arrangement of mixers and centrifuges along with acidic solutions and recycle streams to remove these contaminants from the compositions.

19 Claims, 9 Drawing Sheets

Related U.S. Application Data

(60) Provisional application No. 61/785,061, filed on Mar. 14, 2013.

(56) References Cited

U.S. PATENT DOCUMENTS

| | | | |
|---|---|---|---|
| 2009/0314688 | A1 | 12/2009 | Gordon et al. |
| 2010/0056833 | A1 | 3/2010 | Suarez et al. |
| 2010/0163457 | A1 | 7/2010 | Subramaniyam |
| 2011/0049012 | A1 | 3/2011 | Stigsson et al. |

FOREIGN PATENT DOCUMENTS

| | | | |
|---|---|---|---|
| JP | 07-011283 | A | 1/1995 |
| JP | 2006-028466 | A | 2/2006 |
| JP | 2010-516627 | A | 5/2010 |
| JP | 2011-505446 | A | 2/2011 |
| JP | 2011-518243 | A | 6/2011 |
| WO | WO-2012/130747 | | 10/2012 |

OTHER PUBLICATIONS

Alfa Laval Brochure, "Alfa Laval—disc stack centrifuge technology," accessed at <http://local.alfalaval.com/en-us/key-technologies/separation/separators/daf-oil-recovery/Documents/Alfa_Laval_disc_stack_centrifuge_techonology.pdf> on Oct. 21, 2015, 8 pages.

Alfa Laval Brochure, "Alfa Laval solutions for biodiesel production," (2008) 12 pages.

Antoniassi, R. et al, "Pretreatment of Corn Oil for Physical Refining," JAOCS, vol. 75, No. 10, 1998, pp. 1411-1415.

B. Yang & C.E. Wyman, "Pretreatment: the key to unlocking low-cost cellulosic ethanol," Biofuels, Bioprod. Bioref. 2:26-40 (2008).

Beare-Rogers, J. et al, "Lexicon of Lipid Nutrition," Pure and Applied Chemistry, vol. 73, No. 4, 2001, pp. 685-744.

Doty, D.M., "Removal of Polyethylene and Other Polymeric Materials from Rendered Animal Fat," The Director's Digest, Fats and Proteins Research Foundation, Inc., 90, (1971) 4 pgs.

Erickson et al., "Soybean Oil Modern Processing and Utilization," American Soybean Association, 1990, 20 pages.

Feddern et al., "Animal Fat Wastes for Biodiesel Production," Biodiesel—Feedstocks and Processing Technologies (2011), pp. 45-70.

Fjerbaek et al., "A Review of the Current State of Biodiesel Production Using Enzymatic Transesterification," Biotechnology and Bioengineering, vol. 102, No. 5, Apr. 1, 2009, pp. 1298-1315.

Groschen, R., "Overview of: The Feasibility of Biodiesel from Waste/Recycled Greases and Animal Fats," Marketing Services Division, Minnesota Department of Agriculture, Oct. 2002, 28 pages.

Gunstone, F.D. et al., "The Lipid Handbook," Ch. 3 & 6, Chapman & Hall, Second Edition, 1994.

International Search Report and Written Opinion in International Application No. PCT/US2014/020228 dated Aug. 8, 2014 (8 pages).

Mosier et al., "Features of promising technologies for pretreatment of lignocellulosic biomass," Bioresource Technology 96 (2005) pp. 673-686.

Notice of Allowance in U.S. Appl. No. 14/775,095, dated Mar. 29, 2016 (11 pages).

Notice of Reasons for Rejection dated Apr. 13, 2017 in JP Application No. 2016-500590 (4 pages-English translation included).

METHOD OF REMOVING A CONTAMINANT FROM A CONTAMINANT-CONTAINING BIOLOGICAL COMPOSITION USEFUL AS A BIOFUEL FEEDSTOCK

CROSS-REFERENCE TO RELATED APPLICATIONS

This application is a continuation of U.S. application Ser. No. 14/775,095, now U.S. Pat. No. 9,404,064, filed on Sep. 11, 2015, which is a U.S. National Stage Application under 35 U.S.C. §371 of International Application No. PCT/US2014/020228, filed on Mar. 4, 2014, which claims the benefit of U.S. Provisional Application No. 61/785,061, filed on Mar. 14, 2013, the entire disclosures of which are hereby incorporated by reference for any and all purposes.

BACKGROUND OF THE INVENTION

Field of the Disclosure

The disclosure generally relates to a method of treating a biological composition for use in its downstream conversion to a biofuel and, more specifically, to a method of removing one or more contaminants from a contaminant-containing biological composition that includes animal fats and plant oils.

Brief Description of Related Technology

Biomass is a renewable alternative to fossil raw materials in production of liquid fuels (e.g., biofuels) and chemicals. Increase of biofuels production is part of the government's strategy to improve energy security and reduce green house gas emissions. However, most biomass has high oxygen content which lowers fuel quality and heat value. Upgrading biomass or biomass intermediates into high quality hydrocarbon fuels thus requires removal of oxygen. The biomass oxygen may be in the form of an ester, carboxylic acid, or hydroxyl groups. Removal of oxygen by catalytic reaction with hydrogen is referred to as hydrodeoxygenation (HDO). This reaction may be conducted with conventional fixed-bed, bimetallic, hydrotreating catalysts, such as sulfided nickel-molybdenum (NiMo) or cobalt-molybdenum (CoMo), which are commonly used in refineries.

Unrefined plant oils (e.g., vegetable oils) and animal fats have undesirable quantities of phosphorus in the form of phospholipids and other contaminants, including metals. In addition, animal fats may contain significant amounts of metal salts (e.g., metal chloride salts), which are sufficiently soluble in the fat/grease feeds, but undesirably may precipitate during the HDO reaction and may plug the catalyst bed. The metals/salts can also deactivate the catalyst by reducing available pore surface to accomplish efficient chemical reactions. In the presence of free fatty acids, salts like metal chlorides may form soluble soaps (e.g. calcium stearate). In such form, metals are difficult to remove using conventional cleanup technologies such as water washing.

Several prior art processes for producing fuels from starting materials such as plant oils and animal fats are known. Conversion of vegetable oils to n-paraffins has been reported in the prior art. Some prior art has shown that the process may be applied to other forms of biomass such as tall oil fatty acids, animal fats, and restaurant greases. Hydroisomerization of the bio-derived n-paraffins to isoparaffinic diesel has been taught in the prior art. Other prior art describes use of feed treatment upstream of an HDO reactor. See generally, U.S. Pat. No. 8,026,401, the disclosure of which is incorporated herein by reference.

As described in US-2009-0314688 A1, the disclosure of which is incorporated herein by reference, when producing biodiesel from crude oils, it is highly desirable to reduce the phosphorus content to at most 20 parts per million (ppm) in oil, grease, fat or tallow feedstock to ensure that the final product meets governmental regulatory standards on diesel engine exhaust emission. Oil refining procedures depend on the type of oil and its composition and usually consist of degumming, alkali neutralization, bleaching and deodorization. Degumming refers to the removal of phosphatides and other similar compounds by adding water and/or acid to oil and centrifuging. The main purpose of the degumming is to remove phosphorus, which is present in the crude oil in the form of hydratable phosphatides and non-hydratable phosphatides. Without efficient removal of the phosphatides, the downstream refining processes may not deliver acceptable results. In addition to the removal of non-hydratable phosphatides, the removal of iron and other metals and salts thereof is highly desirable. Thereafter, the oil can be bleached, dewaxed, hydrogenated, and/or deodorized to produce a more stable product.

A number of degumming methods are known in this art, including water degumming (treatment of crude oil with hot water); acid degumming (treatment of crude oil with phosphoric acid or citric acid); acid refining (treatment of water-degummed oil with an acid, which is then partially neutralized with alkali and centrifuged to remove residual gums and free fatty acids); dry degumming (acid degumming with very small amount of water, combined with bleaching); enzymatic degumming (modification of phospholipids with enzymes to obtain the water-soluble compounds); degumming with help of chelating agents (EDTA-ethylenediaminetetraacetic acid, aspartic amino acid, organic malic and fumaric acids, etc.); and membrane/ultra filtration degumming (passage of crude oil through a semi permeable membrane impermeable to phospholipids).

US-2010-0056833 A1, the disclosure of which is incorporated herein by reference, describes a process that attempts to address the aforementioned problems of gumming and contaminant removal from a composition that contains both animal fats and plant oils. The inventors here have discovered improvements on the teachings set forth in this publication.

SUMMARY OF THE INVENTION

Disclosed herein is a method of removing a contaminant from a contaminant-containing biological composition that includes animal fats and plant oils. The method generally includes mixing the contaminant-containing biological composition with a first mixture of a first aqueous solution having a pH less than about 7 and an acidic solution to produce an acid-rich biological composition. The acid-rich biological composition is centrifuged to produce a contaminant-deficient, acid-rich biological composition and an aqueous waste product containing a portion of the contaminant removed from the contaminant-containing biological composition. Thereafter, the contaminant-deficient, acid-rich biological composition is mixed with a second aqueous solution having a pH greater than that of the first aqueous solution to produce a second mixture. This second mixture is centrifuged to produce a contaminant-deficient biological composition and the first aqueous solution. The contaminant-deficient biological composition is then mixed with a pH-neutral aqueous solution to produce a third mixture. And this third mixture is then centrifuged to produce the second aqueous solution and a contaminant-depleted biological composition comprising the animal fats and plant oils. The contaminant-depleted biological composition can be used in downstream processes useful in the manufacture of a bio-based fuel (biofuel) product.

Additional features of the invention may become apparent to those skilled in the art from a review of the following detailed description, taken in conjunction with the drawings, the examples, and the appended claims.

BRIEF DESCRIPTION OF THE DRAWING FIGURES

For a more complete understanding of the disclosure, reference should be made to the following detailed description and accompanying drawing figures wherein.

Figure 1:
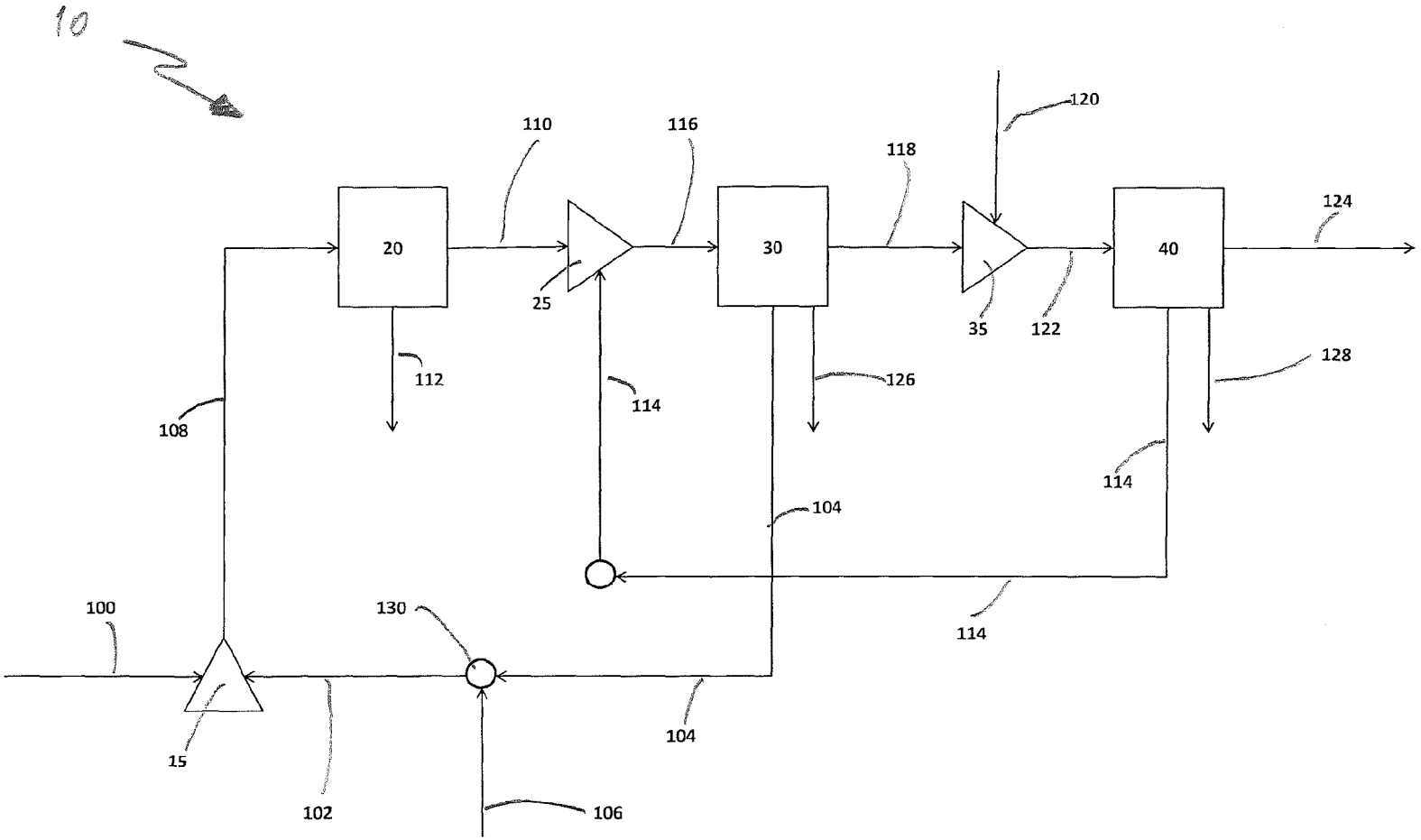
FIG. 1 is a process flow diagram of one embodiment of the disclosed, inventive method.

While the disclosed method is susceptible of embodiments in various forms, there are illustrated in the drawing figures (and will hereafter be described) specific embodiments of the invention, with the understanding that the disclosure is intended to be illustrative, and is not intended to limit the invention to the specific embodiments described and illustrated herein

DETAILED DESCRIPTION OF THE INVENTION

The invention generally relates to treating a biological composition containing animal fats and plant oils such that the material is better suited for processing into a bio-based fuel (biofuel) product. Various embodiments of this treatment process are described herein. But, generally, the treatment method is defined by the removal of a contaminant from a contaminant-containing biological composition that includes animal fats and plant oils. The contaminants may vary, and are described in further detail below. The composition also may vary, but it is one that contains animal fats, and often in significant proportions. Such a composition has heretofore been difficult to treat to remove contaminants without damaging unit operations or requiring significant maintenance of such operations.

Generally, the method includes mixing the contaminant-containing biological composition with a first mixture of a first aqueous solution having a pH less than about 7 and an acidic solution to produce an acid-rich biological composition product. The acid-rich biological composition product is centrifuged to produce a contaminant-deficient, acid-rich biological composition and an aqueous waste product containing a portion of the contaminant removed from the contaminant-containing biological composition. Thereafter, the contaminant-deficient, acid-rich biological composition is mixed with a second aqueous solution having a pH greater than that of the first aqueous solution to produce a second mixture. This second mixture is centrifuged to produce a contaminant-deficient biological composition and the first aqueous solution. The contaminant-deficient biological composition is then mixed with a pH-neutral aqueous solution to produce a third mixture. And this third mixture is then centrifuged to produce the second aqueous solution and a contaminant-depleted biological composition comprising the animal fats and plant oils. The contaminant-depleted biological composition can be used in downstream processes useful in the manufacture of a biofuel product.

Various conditions and features of this method are set forth below. Generally, a biological composition containing animal fats and plant oils is received at the site of the disclosed process by, for example, railcar(s) or tanker trucks. The composition is pumped from this source through a suitable screen (e.g., a 0.1 inch rotating screen) to remove gross contamination or impurities. Thereafter it is pumped to a storage tank. When ready for processing, the composition is metered into the method (process) disclosed herein by way of one or more pumps (e.g., a variable frequency positive displacement pump) to ensure a sufficiently constant feed to the process. The composition may be preheated in a heat exchanger (e.g., a shell-in-tube or a plate-and-frame type heat exchanger employing steam or water as the heat transfer medium). If heated, the biological composition preferably will have a temperature between about 60° C. and 140° C. Heat exchangers optionally may be employed throughout the contaminant-removal method described herein, as necessary or as desired by the operator, to maintain a similar temperature. The composition may optionally pass through a series of filter bags (e.g., 800-micron sized openings). Following these offloading, filtration, and heating steps, the composition may be processed in accordance with the method generally described in the preceding paragraph and as described hereinafter.

For the ease of further discussion, the reader's attention is drawn to FIG. 1, which is a process flow of the method 10. The method 10 includes various process streams communicating with first, second, and third centrifuges 20, 30, and 40, respectively, as well as with first, second, and third mixers 15, 25, and 35, respectively. Among the various process streams shown in FIG. 1, a contaminant-containing biological composition 100 is mixed with a first mixture 102 of a first aqueous solution 104 having a pH less than about 7 and an acidic solution 106 to produce an acid-rich biological composition 108. The acid-rich biological composition product 108 is centrifuged to produce a contaminant-deficient, acid-rich biological composition 110 and an aqueous waste product 112 containing a portion of the contaminant removed from the contaminant-containing biological composition 108. As shown in FIG. 1, the mixing is shown to take place in the first mixer 15, and the centrifuging is shown to occur in the first centrifuge 20. Thereafter, the contaminant-deficient, acid-rich biological composition 110 is mixed with a second aqueous solution 114 having a pH greater than that of the first aqueous solution 104 to produce a second mixture 116. This second mixture 116 is centrifuged to produce a contaminant-deficient biological composition 118 and the first aqueous solution 104. As shown in the figure, the mixing is shown to take place in the second mixer 25, and the centrifuging is shown to occur in the second centrifuge 30. The contaminant-deficient biological composition 118 is then mixed with a pH-neutral aqueous solution 120 to produce a third mixture 122. And this third mixture 122 is then centrifuged to produce the second aqueous solution 114 and a contaminant-depleted biological composition 124 that contains the animal fats and plant oils. As shown in the figure, the mixing is shown to take place in the third mixer 35, and the centrifuging is shown to occur in the third centrifuge 40. The contaminant-depleted biological composition 124 can be used in downstream processes (not shown) useful in the manufacture of a biofuel product.

The step of centrifuging in the first centrifuge 20 can include production of a first rag component (not shown), at least about 90% (by volume) of which is divided to form a portion of the contaminant-deficient, acid-rich biological composition 110, and the balance (by volume) of which forms the aqueous waste product 112. In a preferred embodiment, at least about 95% (by volume) of the first rag component is divided to form a portion of the contaminant-deficient, acid-rich biological composition 110, and the balance (by volume) of which forms the aqueous waste product 112.

The step of centrifuging in the second centrifuge 30 can include production of a second rag component (not shown), 10% (by volume) or less of which is divided to form a portion of the contaminant-deficient, biological composition 118, and the balance (by volume) of which forms a portion of the first aqueous solution 104. In a preferred embodiment, 5% (by volume) or less of the second rag component is divided to form a portion of the contaminant-deficient, biological composition 118, and the balance (by volume) of the second rag component forms a portion of the first aqueous solution 104.

The step of centrifuging in the third centrifuge 40 can include production of a third rag component (not shown), 10% (by volume) or less of which is divided to form a portion of the contaminant-depleted biological composition 124, and the balance (by volume) of which forms a portion of the second aqueous solution 114. In a preferred embodiment, 5% (by volume) or less of the third rag component is divided to form a portion of the contaminant-depleted biological composition 124, and the balance (by volume) of the third rag component forms a portion of the second aqueous solution 114.

It has been discovered that the above-described arrangement of centrifuges and process streams in combination with the divisions of the various rag components obtained in each centrifuge leads to a more contaminant-free biological composition than if only a single centrifuge is employed. Further, and while not wishing to be bound to any particular theory, it is believed that the above-described arrangement of centrifuges and process streams in combination with the divisions of the various rag components obtained in each centrifuge leads to a more contaminant-free biological composition (i.e., a more desirable product) than obtainable if, for example, the pH of the second aqueous solution 114 is less than that of the first aqueous solution 104 or if the pH-neutral aqueous solution 120 is introduced in either of the first two mixers 15 and 25 (instead of the third mixer 35). Mixing the most contaminated of the biological streams with the most acidic (lowest pH) of the wash solutions (e.g., the first aqueous solution 102), and, downstream thereof, mixing a less contaminated biological composition with a less acidic solution (e.g., mixing the contaminant-deficient, acid-rich biological composition 110 with the second aqueous solution 114, and mixing the contaminant-deficient, biological composition 118 with the pH-neutral aqueous solution 120), is believed to yield a much desired product (referred to above as the contaminant-depleted biological composition 124), substantially reduced in the amount of contaminant relative to the composition sought to be processed (e.g., the contaminant-containing biological composition 100).

Figure 2:
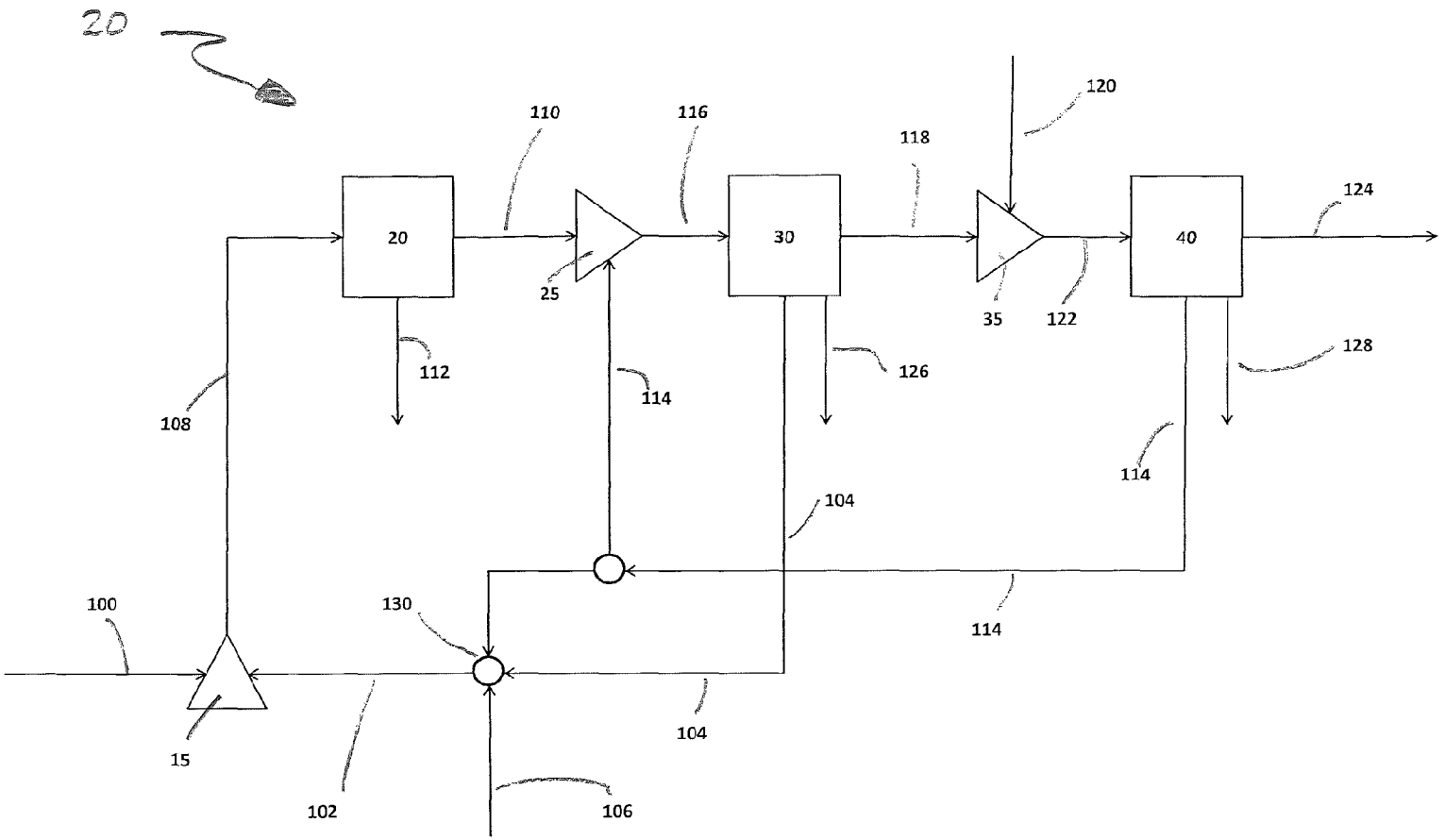
FIG. 2 is a process flow diagram of another embodiment of the disclosed, inventive method; and, FIGS. 3A through 6 graphically illustrate the contaminant removal achieved by a pilot-plant scale embodiment according to the disclosed inventive method.
Figure 3A:
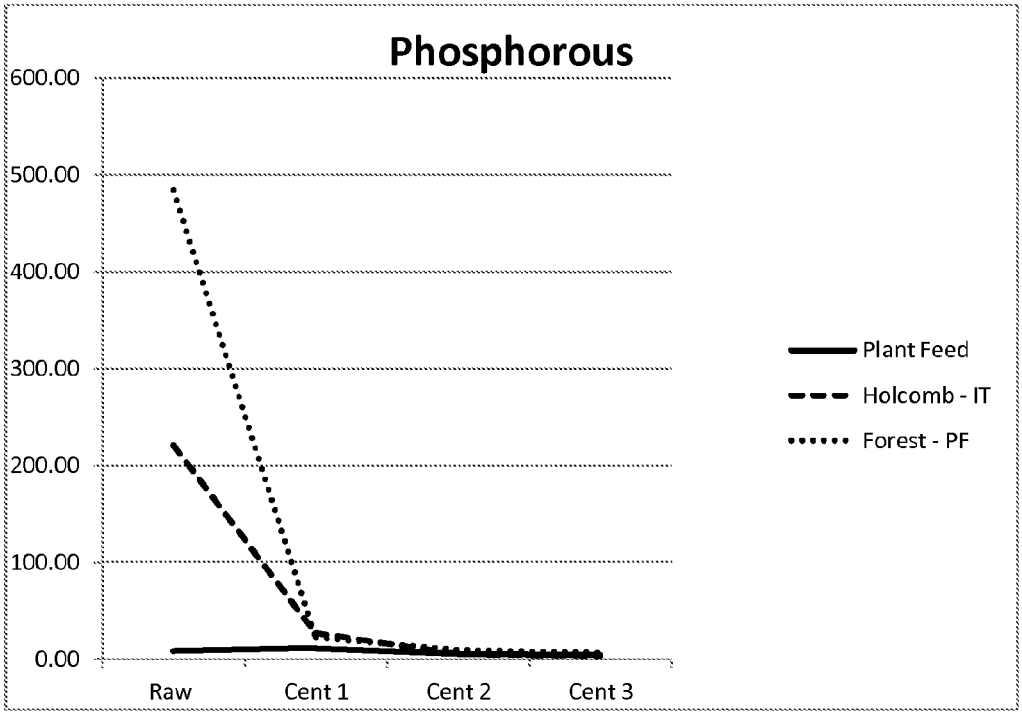
Figure 3B:
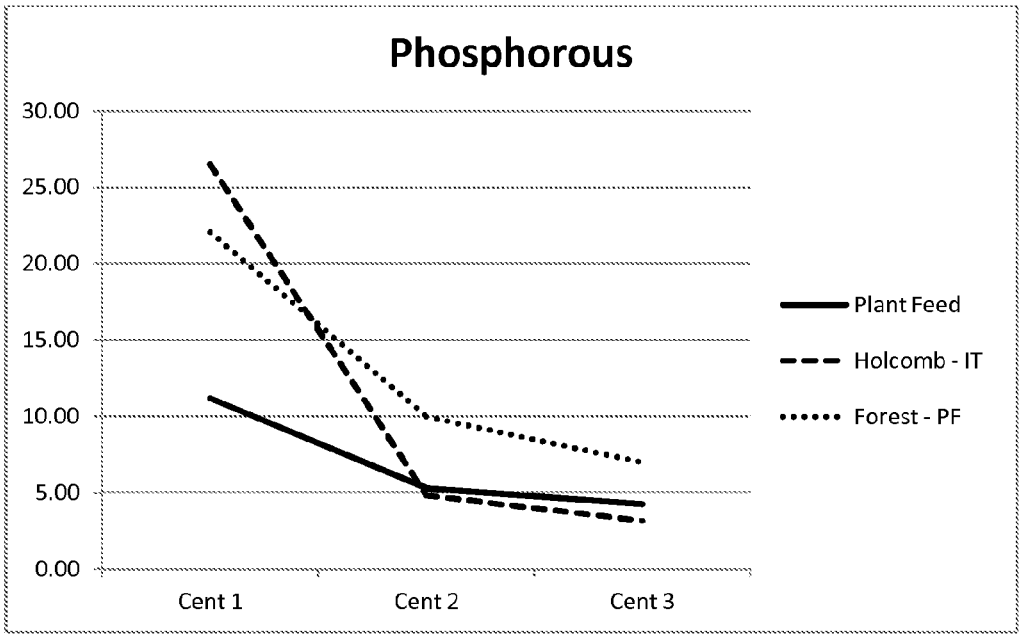
Figure 4A:
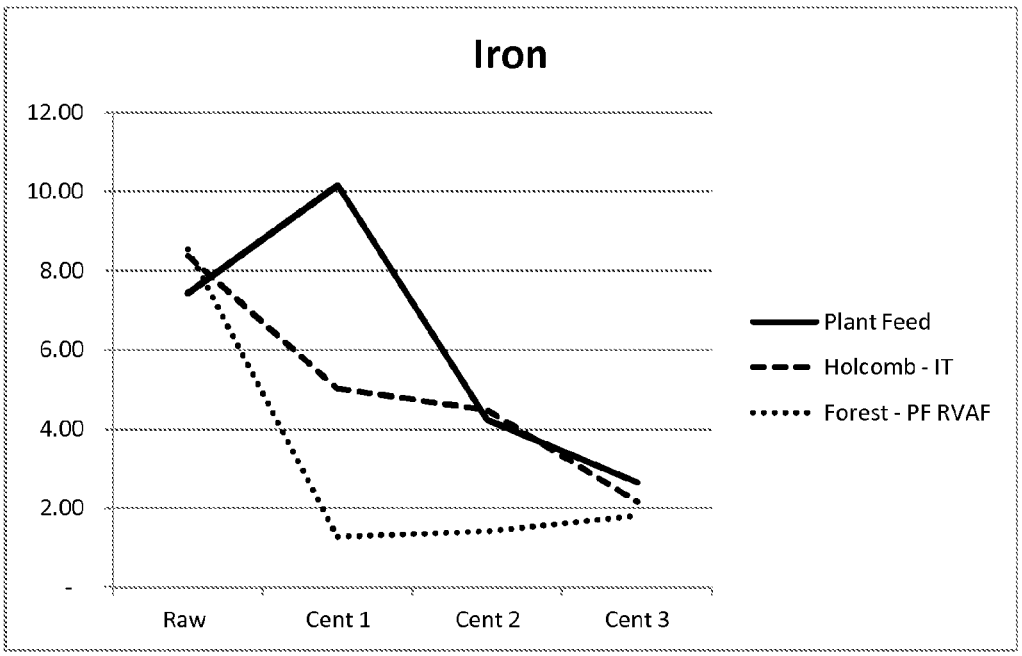
Figure 4B:
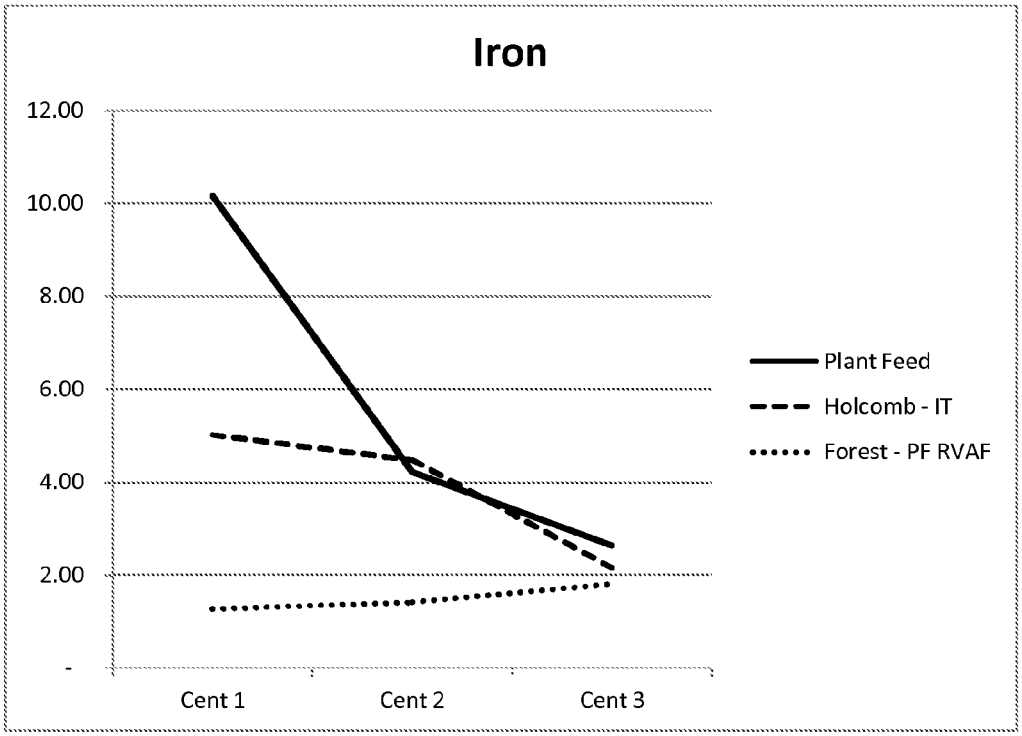
Figure 5A:
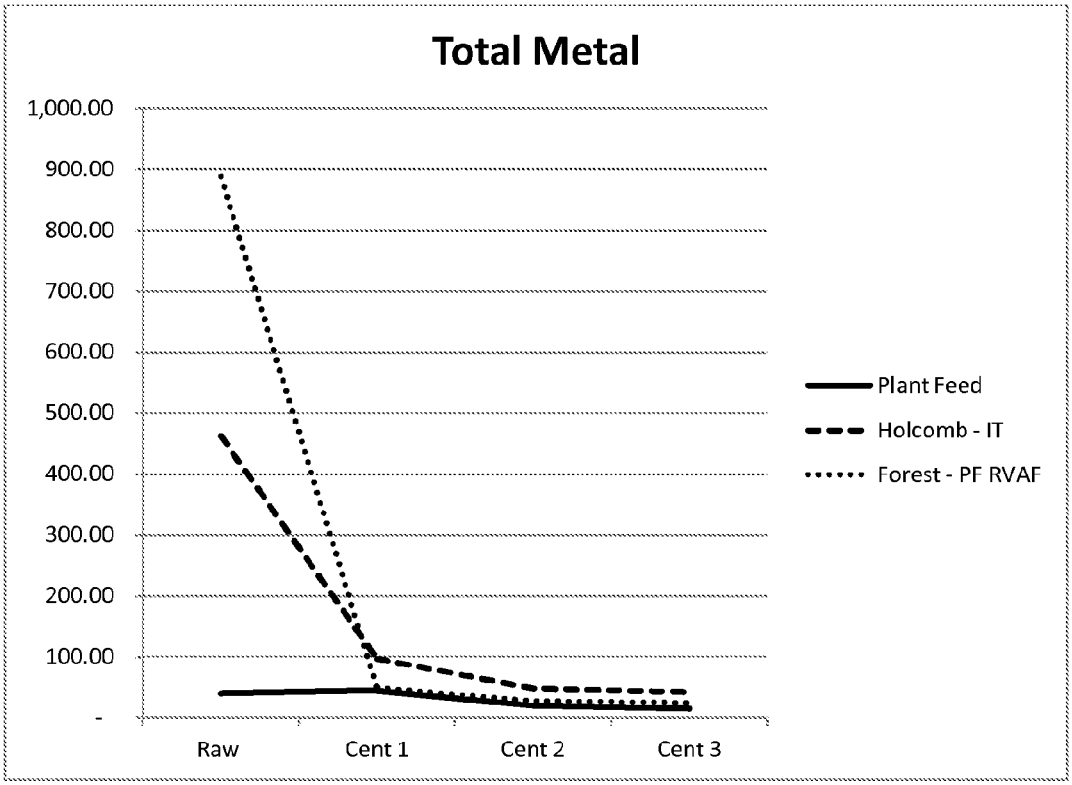
Figure 5B:
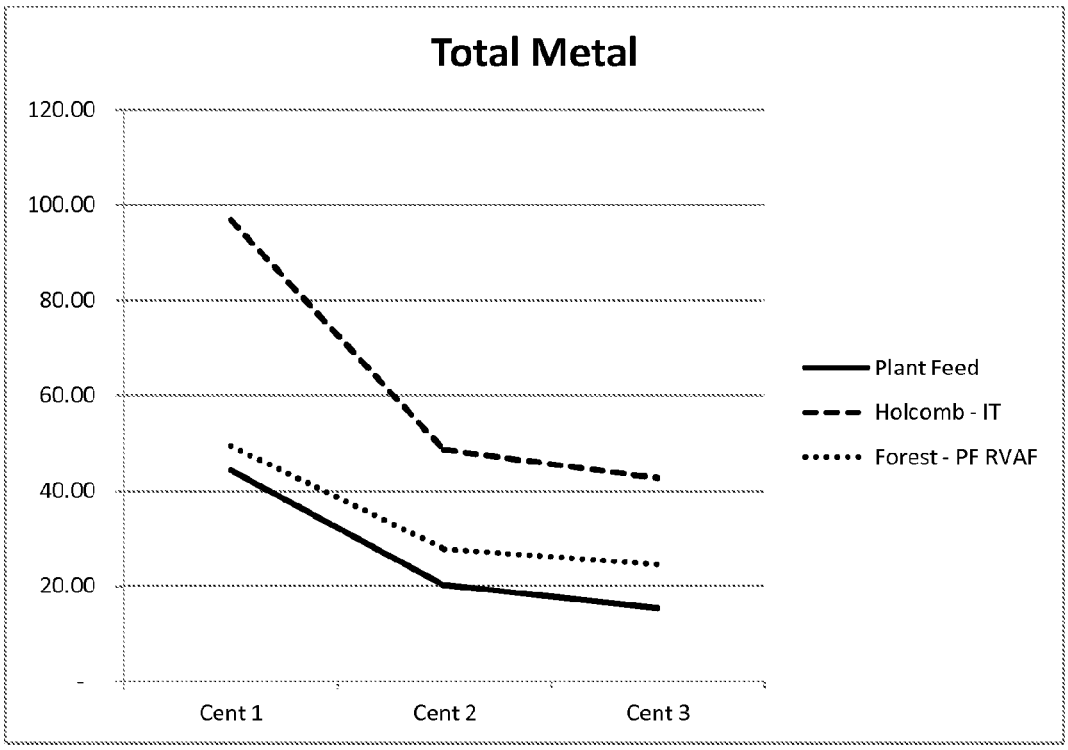
Figure 6:
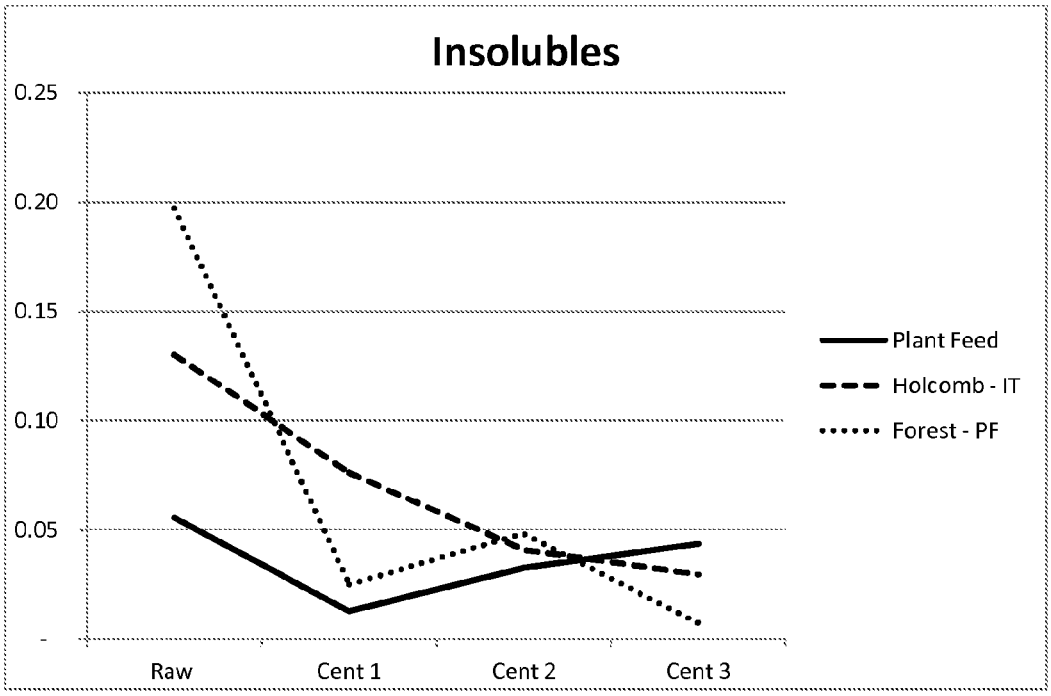

FIG. 2 illustrates an alternative embodiment 12 of the method. As illustrated therein, the first mixture 102 includes at least a portion of the second aqueous solution 114. The second aqueous solution 114 may pass through appropriate flow control valve 130 and be combined thereafter directly with the second aqueous solution or upstream of that solution, for example with the acidic solution 106 and/or with the first aqueous solution 104. The first and second aqueous solutions 104 and 114, respectively, may be expected to contain acid and contaminants (as described hereinafter) as well as acid-contaminant complexes, as well as small amounts of other insoluble materials. Generally, the composition of these two solutions is not expected to drastically differ. Accordingly, this is one reason why the skilled artisan may chose to employ the process depicted in FIG. 2. Although not depicted in either of FIG. 1 or 2, each of these solutions 104 and 114, may optionally pass through filters to remove non-aqueous matter, such as sludge, present therein prior to being recycled in the manner depicted in each figure. Further, and although not depicted in either of FIG. 1 or 2, each of these solutions 104 and 114, may optionally undergo intermediate processing to separate and remove spent acid-contaminant complexes from these solutions prior to the solutions being recycled in the manner depicted in each figure.

The contaminant sought to be removed by the method disclosed herein includes a material selected from the group consisting of a chlorine-containing compound, a nitrogen-containing compound, a phosphorous-containing compound, a sulfur-containing compound, a metal, and mixtures thereof. Among that group, the metal, if present, is selected from the group consisting of barium, iron, calcium, magnesium, lithium, potassium, sodium, boron, chromium, copper, lead, manganese, nickel, silicon, strontium, zinc, and mixtures thereof. The method is believed to be especially effective at removing phosphorous-containing compounds. Such compounds are prevalent in large amounts in biological compositions that contain animal fats relative to compositions that do not contain such fats or contain low amounts of such fats. Thus, in the pretreatment of biological compositions containing animal fats, and especially large amounts of such fats, the removal of these compounds is especially beneficial to downstream processing into a biofuel.

As noted above, the method is useful to remove a contaminant, and particularly those contaminants listed above, from a contaminant-containing biological composition comprising animal fats and plant oils. The contaminant-containing biological composition generally includes one or more of naturally-occurring fatty acids and naturally-occurring fatty acid esters. In certain embodiments, the composition includes a material selected from the group consisting of algae oils, beef tallow, brown grease, camelina oil, canola/rapeseed oil, castor oil, choice white grease, coconut oil, coffee bean oil, corn oil, fish oils, hemp oil, Jatropha oil, linseed oil, mustard oil, palm oil, poultry fat, soybean oil, sunflower oil, tall oil, tall oil fatty acid, Tung oil, used cooking oils, yellow grease, and mixtures thereof. In additional embodiments, the composition contains a material selected from the group consisting of beef tallow, fish oils, poultry fat, used cooking oils, yellow grease, and mixtures thereof, this group understood to be a major source of animal fats.

Animal fats are readily available because slaughter industries, for example are generally well managed for product control and handling procedures. But, animal fats are known to be highly viscous and exist in solid form at room temperature because of the high concentration of saturated fatty acids (versus plant-based oils, which have higher concentrations of unsaturated fatty acids). The high viscosity generally leads to difficulties in use as a fuel due to poor atomization, even though they are generally less resistant to cold weather temperatures than fuels made from plant-based materials. The method is believed to be especially effective at removing contaminants, such as phosphorous-containing compounds, from biological compositions that contain a greater proportion by weight of animal fats than plant oils. For example, it is believed that the method is especially effective at removing contaminants, such as phosphorous-containing compounds, from biological compositions wherein animal fats and plant oils are present in the contaminant-containing biological composition in a weight ratio of animal fats:plant oils of about 0.5:1 to about 99:1, and preferably where the weight ratio is about 5:1 to about 90:1.

The acidic solution (106) employed in the method has a pH of less than about 7. In an alternative embodiment the acidic solution has a pH of less than about 6. In another alternative embodiment, the acidic solution has a pH of less than about 5. Generally, the acidic solution includes an acid selected from the group consisting of citric acid, sulfuric acid, phosphoric acid, hydrochloric acid, nitric acid, acetic acid, carbonic acid, and mixtures thereof. Preferably, the acidic solution includes citric acid, and even more preferably it consists essentially of citric acid (to the exclusion of other acids). It is believed that citric acid works especially well at removing the types of contaminants, such as phosphorous-containing compounds, encountered in biological compositions that include animal fats. For example, it is believed that citric acid works better than do sulfuric acid and phosphoric acid in this context. Accordingly, in certain embodiments, the acidic solution includes about 20 wt. % to about 75 wt. % citric acid, based on the total weight of the acidic solution. In another embodiment, the acidic solution includes about 20 wt. % to about 40 wt. % citric acid, based on the total weight of the acidic solution.

Reduced amounts of citric acid, however, are also possible depending upon the type of the mixer employed to mix the compositions fed to the various centrifuges. Among the mixers suitable for use in the disclosed method are static mixers, stirred tank mixers, and high shear mixers (e.g., a high shear pump or cavitation mixers). The more vigorous the mixing, the lower the concentration of acid that may be necessary to achieve desirable results (e.g., separation and downstream removal of contaminants).

The first mixer 20 is useful to mix the contaminant-containing biological composition with the first mixture 102 to produce an acid-rich biological composition 108, which is fed to the first centrifuge. The first mixture 102 is a mixture of solutions that include the acidic solution 106 described above. The acid-rich biological composition 108, itself being a mixture that includes the acidic solution 106, likely has a pH of slightly greater than that of the acidic solution and generally less than about 7. In alternative embodiments, where, for example, the acidic solution 106 has a pH of less than about 6, the acid-rich biological composition 108 has a pH of about 6. In other embodiments, where, for example the acidic solution 106 has a pH of less than about 5, the acid-rich biological composition 108 has a pH of about 5. In one embodiment, the contaminant-containing biological composition 100 and the first mixture 102 are mixed in a mass ratio of about 5:1 to about 50:1.

The acid-rich biological composition 108 is centrifuged in the first centrifuge 20 to produce the contaminant-deficient, acid-rich biological composition 110 and an aqueous waste product 112 containing a portion of the contaminant removed from the contaminant-containing biological composition 100. In certain embodiments, the aqueous waste product 112 includes at least about 50% of the contaminant present in the contaminant-containing biological composition 100, and in other embodiments the aqueous waste product 112 includes at least about 75% of the contaminant present in the contaminant-containing biological composition 100. Further, in certain embodiments the contaminant-deficient, acid-rich biological composition 110 includes less than about 50% of the contaminant present in the contaminant-containing biological composition 100, and in other embodiments the contaminant-deficient, acid-rich biological composition 110 includes less than about 25% of the contaminant present in the contaminant-containing biological composition 100. Of course, the more contaminant that can be removed in this first centrifuge the better. But, it has been discovered that even instances were nearly all of the contaminant sought to be removed from the contaminant-containing biological composition has been removed, additional amounts of that contaminant may be effectively removed in subsequent centrifugation steps, as described below.

The first centrifuge 20 (like the second and third centrifuges 30 and 40, respectively) is a disc stack centrifuge. A disc stack centrifuge is useful for separation tasks that involve low solids concentrations and small particle and droplet sizes encountered in the type of liquid-liquid and liquid-solid compositions that make up the biological compositions employed in the disclosed method. A disc stack centrifuge generally separates solids and one or two liquid phases from each other in a single continuous process, using very high centrifugal forces. The more dense solids (e.g., contaminants such as metals) are subject to such great forces that they are forced outwards against a rotating bowl wall, while less dense liquids form concentric inner layers. The interface between two such inner layers is referred to herein as a "rag component." The centrifuge may be tuned to permit precise division of this rag component as the operator may so desire. Further, the residence time within each of the three centrifuges may be set by the operator depending upon the level of contamination of the composition and the amount of contaminants sought to be removed. Generally, it is envisioned that the residence time in each of the three centrifuges will range from about 5 seconds to about 60 seconds, however, the three centrifuges need not each operate with the same residence time. The "disc stack" portion of the centrifuge includes plates that provide additional surface area on which components of a centrifuging feed material may settle based on density. It is the particular configuration, shape, and design of these plates that permits the centrifuge to continuously separate a wide range of solids from a mixture of liquids. A concentrated solid (e.g., a sludge) may be continuously, intermittently, or manually removed, as desired by the operator. Disc stack centrifuges suitable for use in accordance with the disclosed method are commercially available from, for example, Alfa Laval (Sweden) and GEA Westfalia Separator Group (Germany).

Following the first centrifuging step, the contaminant-deficient, acid-rich biological composition 110 is mixed in a second mixer 25 with a second aqueous solution 114 to produce a second mixture 116, which is then centrifuged in a second centrifuge 30. In one embodiment, the contaminant-deficient, acid-rich biological composition 110 and the second aqueous solution 114 are mixed in a mass ratio of about 5:1 to about 50:1. The second aqueous solution 114 is a product of a downstream centrifugation and has a pH of less than about 7. However, of the various streams mixed with the biological composition as it progresses through the process, the second aqueous solution 114 has a relative high pH. For example, relative to the first aqueous solution 102, the second aqueous solution 114 has a higher pH. But, relative to the downstream pH-neutral aqueous solution 120, it has a lower pH. The pH-neutral aqueous solution 120 is predominantly made up of water selected from the group consisting of deionized water, demineralized water, and mixtures thereof, and preferably is deionized water. The pH range of the pH-neutral aqueous solution 120 is between about 6 and about 9. Preferably, the pH-neutral aqueous solution 120 has a pH of about 7.

The second mixture 116 is then centrifuged in a second centrifuge 30 to produce a contaminant-deficient biological composition 118 and the first aqueous solution 104. In certain embodiments, the first aqueous solution 104 includes at least about 50% of the contaminant present in the contaminant-deficient, acid-rich biological composition 110, and in other embodiments, the first aqueous solution 104 includes at least about 75% of the contaminant present in the contaminant-deficient, acid-rich biological composition 110. Further, in certain embodiments, the contaminant-deficient biological composition 118 includes less than about 50% of the contaminant present in the contaminant-deficient, acid-rich biological composition 110, and in other embodiments, the contaminant-deficient biological composition 118 includes less than about 25% of the contaminant present in the contaminant-deficient, acid-rich biological composition 110. The first aqueous solution 104 preferably has a pH of less than about 7, and more preferably less than 7 but higher than that of the acidic solution 106 with which it is combined to form the first mixture 104.

The contaminant-deficient biological composition 118 exiting the second centrifuge 30 is then mixed in a mixer 35 with the pH-neutral aqueous solution 120 to form the third mixture 122, which is then centrifuged in a third centrifuge 40. In one embodiment, the contaminant-deficient biological composition 118 and pH-neutral aqueous solution 120 are mixed in a mass ratio of about 5:1 to about 50:1. Following this mixing, the produced third mixture 122 is centrifuged in a third centrifuge 40 to produce the second aqueous solution 114 (described above), and the contaminant-depleted biological composition 124 containing the animal fats and plant oils. In certain embodiments, the second aqueous solution 114 includes at least about 50% of the contaminant present in the contaminant-deficient biological composition 118, and in other embodiments, the second aqueous solution 114 includes at least about 75% of the contaminant present in the contaminant-deficient biological composition 118. Further, in certain embodiments, the contaminant-depleted biological composition 124 includes less than about 50% of the contaminant present in the contaminant-deficient biological composition 118, and in other embodiments the contaminant-depleted biological composition 124 includes less than about 25% of the contaminant present in the contaminant-deficient biological composition 118.

In accordance with the above-described process (of centrifuges and mixers), and in one embodiment, the contaminant-depleted biological composition 124 includes less than about 5 wt. % of the contaminant introduced to the process via the contaminant-containing biological composition 100. In another embodiment, the contaminant-depleted biological composition 124 includes less than about 2 wt. % of the introduced to the process via the contaminant-containing biological composition 100. Alternatively, the contaminant-depleted biological composition 124 preferably has a total metals content of less than about 50 parts per million (weight basis) (hereinafter "ppm"), more preferably less than 10 ppm, and even more preferably less than 2 ppm. Further, the contaminant-depleted biological composition 124 preferably has a phosphorous-containing compound content of less than about 20 ppm, more preferably less than about 10 ppm, and even more preferably less than about 5 ppm. This treatment of the fed composition 100 and the removal of contaminants therefrom results in sludge streams (e.g., streams 126 and 128) exiting the centrifuges, as noted above. These sludge streams contain the contaminants and generally include insoluble impurities having a density greater than water.

As noted above in the discussion of the disc stack centrifuges, the centrifuges are desirably equipped with adjustable levers (or fingers) that can move the separation zone (of the rag component). Within the interior of the centrifuges, which interior is partially defined by a bowl, centrifugal forces throw the heavy material (sludge) to an outer region of the bowl where the sludge can accumulate until it is eventually removed during, for example, a timed desludge cycle. An aqueous acidic solution more dense than the oil will settle adjacent the sludge layer. The oil phase, being the least dense relative to the acidic solution and the sludge, will wattle in an interior region of the bowl. Between each layer is an emulsion layer of partially separated material, which is referred to herein as the rag component. The rag component in each centrifuge contains a clean (or light phase) oil as well as water and contaminants such as phospholipids present as an emulsion. In a first centrifuge, based on the division of the first rag component specified herein, a significant proportion (by volume) of the first rag component (and the heavy phase therein) is sent to the second centrifuge in an attempt to further separate the desirable oils from the undesirable aqueous acidic solution and contaminants. Ultimately, and following the third centrifuge, the collected aqueous solution may be recycled (as shown in the Figures) or portions thereof may be sent to a storage tank for further processing.

The contaminant-depleted biological composition 124 may be further cleansed prior to conversion to a biofuel. That further cleansing may include passing the composition through a pre-coat vacuum filter to remove any residual microscopic fine particles (micro-fines). The filter preferably employs media, such as an acid clay, capable of removing metals and polyethylene remaining in the composition in the form of micro-fines. Thereafter, the cleansed composition may be stored to await conversion to a biofuel or passed directly to such a conversion process (e.g., a hydroconversion reactor system).

Although US-2010-0056833 A1 describes a process of washing a contaminant containing biological composition that includes animal fats with an acid solution countercurrent to the flow of the fresh feed, and the use of a plurality of contactor-separator stages, these suggestions are not believed to adequately address the gumming problems that operators encounter in practice. Of course, additional stages may help; but, there are high capital and operating costs associated with that suggestion. The inventors have now discovered that a particular series of unit operations (centrifugation and mixing steps) better and more reliably address the gumming problem encountered with feed compositions containing animal fats. Furthermore, the arrangement of the unit operations and conditions specified herein advantageously offers the operator of the process the ability to minimize the loss of fresh feedstock (here the contaminant-containing biological composition) while maximizing the removal of contaminants that otherwise contribute to undesirable gumming and ash formation in downstream processing (e.g., HDO processes) and other environmentally-disfavored contaminants. Still further, the disclosed process employs recycle streams to better ensure that that the cleaned biological composition (here the contaminant-depleted biological composition) and treatment water are not cross-contaminated.

EXAMPLE

The following example and data are provided to illustrate the invention, but are not intended to limit the scope thereof.

A pilot plant-scale process was prepared to carry out the experiments disclosed below. The process employed is as shown in FIGS. 1 and 2 unless noted otherwise.

Water production: This involved mixing current plant HDO charge pump material with clean deionized water to prepare the initial water recovered from the third centrifuge. This water was used for the first run for all of the feed water to the first and second centrifuges 20 and centrifuge 30, respectively. After the first sample of the contaminant-containing biological composition (referred to herein as "FOG") was run through all three centrifuge cycles, the water (stream 104) recovered from the second centrifuge 30 was used 50/50 with the water (stream 114) from the third centrifuge 40 in the first centrifuge 20.

The raw FOG's were not filtered. All mixing was mimicked by using a blender, mixing for 30 seconds on the liquefy setting. A pint sample was set aside of the raw feed stock for analysis. The centrifuge was mimicked by using the lab centrifuges, set at 800 G and 200° F. (albeit at low speeds.

The first centrifuge step was performed three times with 900 ml FOG, 21 ml third centrifuge water, 21 ml second centrifuge water and 2 ml 50% citric acid (a pint sample was caught from the top half of centrifuge tubes for analysis).

The second centrifuge step was performed three times with 675 ml FOG recovered from the top half of the centrifuge tubes from the first centrifuge step and 31.5 ml water recovered from the third centrifuge step (a pint sample was caught from the top half of centrifuge tubes for analysis, and collecting water from the bottom of the tube for the next FOG experiment).

The third centrifuge step was performed two times with 450 ml FOG from the top of the centrifuge tubes from the second centrifuge step and 21 ml clean Deionized water, (a pint sample was caught from the top half of centrifuge tubes for analysis, and collecting water from the bottom of the tube for the next FOG experiment).

Four samples from each cycle were tested for comparison, raw, after first centrifuge, after second centrifuge and after third centrifuge.

Most of the samples were not maintained at ~200° F. while mixing and preparing for centrifuging, although tallow FOG was (due to its nature of setting up at lower temperatures). This showed in the third centrifuging step, where a large white/tan rag component appeared—but, after allowing to sit at 200° F. in the idle centrifuge for 30 plus minutes, the large rag turned into a thin rag. The tallow started with the thin rag layer. In commercial-scale operation, a light rag layer in the third centrifuge may be encountered; but, it should be a small layer if the temperature is maintained around 200° F. and otherwise consistent through all three centrifuging steps.

The following FOGs were employed: a plant oil feed containing very little animal fats; an inedible tallow feed containing substantial amounts of animal fats; and a poultry feed containing substantial amounts of animal fats. The plant oil feed was a mixture of 70 wt. % yellow grease and 30% corn oil, based on the total weight of the plant oil feed. In contrast to this plant oil feed, which may be considered as having no meaningful amount of animal fats, the other two feeds contained nearly 100 wt. % animal fats. The point of employing these three FOGs is to demonstrate the unexpectedly good contaminant removal attainable with a feed composition containing animal fats, and significant amounts of animal fats.

FIGS. 3A through 6 illustrate graphically the contaminant removal (in parts per million) achieved by the foregoing pilot-scale process. In the figures, "Holcomb-IT" refers to the inedible tallow feed, and "Forest-PF" refers to the poultry fat feed. The data reported in FIGS. 3A, 3B, 4A, 4B, 5A, and 5B, were obtained by subjecting the samples to ASTM D7111 (Standard Test Method for Determination of Trace Elements in Middle Distillate Fuels by Inductively Coupled Plasma Atomic Emission Spectrometry (ICP-AES)), wherein the middle distillates specified in the test are substituted with the sample (fats, oils, and greases). The data reported in FIG. 6 were obtained by subjecting the samples to AOCS Ca 3a-46 (Insoluble Impurities).

The foregoing description is given for clearness of understanding only, and no unnecessary limitations should be understood therefrom, as modifications within the scope of the invention may be apparent to those having ordinary skill in the art.

What is claimed is:

1. A method of removing a contaminant from a contaminant-containing biological composition comprising animal fats and plant oils, the method comprising:

(a) mixing the contaminant-containing biological composition with a first mixture of a first aqueous solution having a pH less than 7 and an acidic solution to produce an acid-rich biological composition;

(b) centrifuging the acid-rich biological composition to produce a contaminant-deficient, acid-rich biological composition, an aqueous waste product containing a portion of the contaminant removed from the contaminant-containing biological composition, and a first rag component, and subsequently combining 90% or more (by volume) of the first rag component with the contaminant-deficient, acid-rich biological composition and combining the remaining balance (by volume) of the first rag component with the aqueous waste product;

(c) mixing the contaminant-deficient, acid-rich biological composition comprising 90% or more (by volume) of the first rag component with a second aqueous solution to produce a second mixture, wherein the second aqueous solution has a pH less than 7 but greater than the pH of the first aqueous solution;

(d) centrifuging the second mixture to produce a contaminant-deficient biological composition, the first aqueous solution, and a second rag component, and subsequently combining 10% (by volume) or less of which with the contaminant-deficient, biological composition and combining the remaining balance (by volume) of the second rag component with the first aqueous solution;

(e) mixing the contaminant-deficient biological composition comprising 10% (by volume) or less of the second rag component with a pH-neutral aqueous solution to produce a third mixture; and (f) centrifuging the third mixture to produce the second aqueous solution, a contaminant-depleted biological composition comprising the animal fats and plant oils, and a third rag component, and subsequently combining 10% (by volume) or less of which with-the contaminant-depleted biological composition and combining the remaining balance (by volume) with the second aqueous solution.

2. The method of claim 1, wherein the first mixture comprises a portion of the second aqueous solution.

3. The method of claim 1, wherein the second aqueous solution further comprises the acidic solution.

4. The method of claim 1, wherein the contaminant is a material selected from the group consisting of a chlorine-containing compound, a nitrogen-containing compound, a phosphorous-containing compound, a sulfur-containing compound, a metal, and mixtures of any two or more thereof.

5. The method of claim 1, wherein the contaminant-containing biological composition comprises one or more of naturally-occurring fatty acids and naturally-occurring fatty acid esters.

6. The method of claim 5, wherein the contaminant-containing biological composition comprises a material selected from the group consisting of algae oils, beef tallow, brown grease, camelina oil, canola/rapeseed oil, castor oil, choice white grease, coconut oil, coffee bean oil, corn oil, fish oils, hemp oil, Jatropha oil, linseed oil, mustard oil, palm oil, poultry fat, soybean oil, sunflower oil, tall oil, tall oil fatty acid, Tung oil, used cooking oils, yellow grease, and mixtures of any two or more thereof.

7. The method of claim 6, wherein the contaminant-containing biological composition comprises a material selected from the group consisting of beef tallow, fish oils, poultry fat, used cooking oils, yellow grease, and mixtures of any two or more thereof.

8. The method of claim 1, wherein the contaminant-containing biological composition comprises a greater proportion by weight of animal fats than plant oils.

9. The method of claim 1, wherein animal fats and plant oils are present in the contaminant-containing biological composition in a weight ratio of animal fats:plant oils of 0.5:1 to 99:1.

10. The method of claim 9, wherein the weight ratio is 5:1 to 90:1.

11. The method of claim 1, wherein the first aqueous solution has a pH of less than 5.

12. The method of claim 1, wherein the acidic solution comprises an acid selected from the group consisting of citric acid, sulfuric acid, phosphoric acid, hydrochloric acid, nitric acid, acetic acid, carbonic acid, and mixtures of any two or more thereof.

13. The method of claim 12, wherein the acidic solution comprises 20 wt. % to 75 wt. % citric acid, based on the total weight of the acidic solution.

14. The method of claim 13, wherein the acidic solution comprises 20 wt. % to 40 wt. % citric acid, based on the total weight of the acidic solution.

15. The method of claim 1, wherein the contaminant-depleted biological composition comprises less than 5 wt. % of the contaminant.

16. The method of claim 1, wherein the contaminant-containing biological composition and the first mixture are mixed in a mass ratio of 5:1 to 50:1.

17. The method of claim 1, wherein the contaminant-deficient, acid-rich biological composition and the second aqueous solution are mixed in a mass ratio of 5:1 to 50:1.

18. The method of claim 1, wherein the contaminant-deficient biological composition and pH-neutral aqueous solution are mixed in a mass ratio of 5:1 to 50:1.

19. The method of claim 1, wherein steps (b), (d), and (f) are independently performed in a disc stack centrifuge.

* * * * *